US006664939B1

(12) United States Patent
Olinyk et al.

(10) Patent No.: US 6,664,939 B1
(45) Date of Patent: Dec. 16, 2003

(54) FOAM-FILLED ANTENNA AND METHOD OF MANUFACTURING SAME

(76) Inventors: Mark Olinyk, 13224 Reith Miller Rd., Grass Lake, MI (US) 49240; Helmut F. Homann, 16385 - 17½ Mile Rd., Marshall, MI (US) 49068

( * ) Notice: Subject to any disclaimer, the term of this patent is extended or adjusted under 35 U.S.C. 154(b) by 0 days.

(21) Appl. No.: 09/981,306

(22) Filed: Oct. 15, 2001

Related U.S. Application Data

(60) Provisional application No. 60/279,349, filed on Mar. 28, 2001.

(51) Int. Cl.[7] ..... H01Q 15/14
(52) U.S. Cl. ..... 343/912; 29/600
(58) Field of Search ..... 343/912, 839, 343/832, 834, 840, 781 CA; 29/600

(56) References Cited

U.S. PATENT DOCUMENTS

| | | | | | |
|---|---|---|---|---|---|
| 3,897,294 | A | * | 7/1975 | MacTurk | 343/912 |
| 4,035,065 | A | * | 7/1977 | Fletcher et al. | 343/912 |
| 4,171,563 | A | * | 10/1979 | Withoos | 343/912 |
| 4,352,112 | A | | 9/1982 | Leonhardt et al. | 343/912 |
| 4,378,561 | A | * | 3/1983 | Hibbard et al. | 343/912 |
| 4,636,801 | A | | 1/1987 | Myer | 343/912 |
| 4,733,246 | A | | 3/1988 | Rubin et al. | 343/912 |
| 4,763,133 | A | | 8/1988 | Takemura et al. | 343/912 |
| 4,789,868 | A | | 12/1988 | Oono et al. | 343/912 |
| 5,055,854 | A | | 10/1991 | Gustafsson | 343/912 |
| 5,162,810 | A | | 11/1992 | Onisawa et al. | 343/912 |
| 5,617,107 | A | | 4/1997 | Fleming | 343/912 |
| 5,686,930 | A | * | 11/1997 | Brydon | 343/897 |
| 5,796,368 | A | * | 8/1998 | Arthur, III | 343/912 |

* cited by examiner

*Primary Examiner*—Don Wong
*Assistant Examiner*—Ephrem Alemu
(74) *Attorney, Agent, or Firm*—Young & Basile, P.C.

(57) ABSTRACT

A parabolic antenna comprising at least a reflector of deformable material, the reflector having a parabolic shape of a preferred curvature, and a rigid structural substrate comprising a foam sufficient to maintain the parabolic shape of the reflector against significant deviation from said parabolic shape. The deformable material of the reflector is characterized by its inability to maintain the parabolic shape of a preferred curvature in the absence of the rigid structural substrate. A method of forming the inventive antenna is disclosed, comprising the steps of: Providing a backing section and a reflector made of deformable material, the backing section and reflector being mateable to define a hollow interior cavity; maintaining the reflector on a forming die in conformance with a preferred curvature of the reflector; and injecting an expandable, foam slurry into the hollow interior cavity and curing the foam slurry to form the antenna.

12 Claims, 8 Drawing Sheets

FOAM-FILLED ANTENNA AND METHOD OF MANUFACTURING SAME

RELATED APPLICATIONS

This application is related to, and claims the benefit of priority from, U.S. Provisional Patent Application Ser. No. 60/279,349, filed Mar. 28, 2001.

FIELD OF THE INVENTION

The present invention relates to parabolic antennas, such as are employed to receive and/or transmit carrier signals, and a method of forming such antennas and other metal or alloy parts where precise tolerances are required in the finished product. More particularly, the present invention relates to a parabolic antenna comprising a backing section and reflector made of deformable material, for instance metal or alloy, the backing section and reflector being mated to define a hollow interior cavity that is filled with a rigid support structure comprising a closed-cell foam. The present invention also particularly relates to a method of forming accurately dimensioned parts having close tolerances, such as transmission antennas, wherein a deformable material skin, for instance an antenna reflector of metal, is maintained in exact conformance with a vacuum buck, the vacuum buck having a configuration corresponding to the close tolerances of the preferred configuration of the completed part, and wherein a closed-cell foam slurry is provided, the cured foam forming a rigid support structure adequate to maintain the deformable material skin in the preferred configuration thereof following removal of the product from the vacuum buck.

BACKGROUND

Parabolic antennas generally have been around for a number of years and have, in the past several decades, become more and more widely used residentially and commercially for wireless television services, as well as other signal-communications applications. For instance, the advent of direct satellite television service, and the comparative "miniaturization" of the receiving and transmitting antennas have driven, and promise to continue driving, consumer demand for these goods and services. Recent advances in communications technology in particular have led to the development of earth-bound antennas with diameters on the order of tens of centimeters, rather than tens of feet, that are capable of receiving and transmitting signals.

One important consideration in the manufacture and design of such antennas is the fact that, necessarily, antennas are employed in all variety of climates. While parabolic antennas are relatively simple in their design, the fact that signal reception and transmission is dependent upon the shape of the reflector face, or "dish", renders their precise manufacture difficult and, sometimes, expensive. The importance of dish tolerances is especially pronounced in transmission antennas, where variations in the surface of the dish too far from a desired curvature will significantly degrade transmission performance.

Conventional antennas, for instance of the type used for residential satellite reception, are typically composed of a metal skin, manufactured, for example, by stamping. Antenna formed in this fashion do not, by reason of shape "memory" properties of the commonly used materials, retain their preferred curvatures. These drawbacks make such antennas prone to performance degradation, and render them particularly ill-suited to use as transmitting antennas.

In the past, one of the named inventors of this application developed an improved method for forming an antenna having sufficiently close tolerances in the reflector, the method comprising placing one of two panels for an antenna on a vacuum die, and connecting to both panels a structural means such as a plurality of undulating strips to interlock the panels. This methodology is more particularly described in U.S. Pat. No. 4,791,432, issued to Piper et al., the disclosure of which is incorporated herein by reference in its entirety. However, the method of this patent is complicated, requires considerable parts fabrication relative to the structural means, and so is not suited to the inexpensive mass-production of antenna.

Consequently, there is a need for a parabolic antenna that is simple but robust in construction, economical to manufacture, while at the same time able to retain a reflector curvature of high tolerances even through variations in ambient temperatures, wind loading, and other environmental influences.

SUMMARY OF THE DISCLOSURE

The present invention addresses and solves the problems discussed above, and encompasses other features and advantages, by providing a parabolic, or dish-type, antenna comprising a backing section and a reflector of deformable material, such as polymer, metal, alloy, etc., the backing section and reflector being mated to define a hollow interior cavity that is filled with a rigid support structure comprising a closed-cell foam. Advantageously, the rigid support foam provides accurate shape retention for the preferred parabolic curvature of the antenna reflector, even through variations in temperature, wind loading, and other environmental influences.

The present invention also provides an economical and efficient method for forming accurately dimensioned parts having close tolerances, including parabolic antenna of the type of the inventive apparatus, the method comprising the steps of:

(a) providing a backing section and a reflector made of deformable material, the backing section and reflector being mateable to define a hollow interior cavity, and at least the reflector having a first curvature;

(b) providing a forming die including a male portion comprising a vacuum buck having a curved surface of predetermined tolerances exactly corresponding to a second, preferred curvature of the reflector, and a female portion dimensioned to receive the backing section therein;

(c) positioning and maintaining the reflector on the vacuum buck under vacuum pressure in conformance with the curved surface corresponding to the second, preferred curvature of the reflector;

(d) mating the backing section to the reflector;

(e) capturing the backing section and reflector in the mated condition thereof between the male and female portions of the forming die;

(f) injecting an expandable, closed-cell foam slurry into the hollow interior cavity defined between the mated backing section and reflector;

(g) while maintaining the reflector on the vacuum buck in conformance with the curved surface corresponding to the second, preferred curvature the curved surface corresponding to the second, preferred curvature of the reflector, curing the closed-cell foam slurry to form a rigid support structure; and (h) releasing the vacuum pressure at the vacuum buck to thereby form an antenna wherein the reflector has a curvature corresponding to the second, preferred curvature.

BRIEF DESCRIPTION OF THE DRAWINGS

These and other objects, features, and advantages of the present invention will become apparent upon reference to the following description and drawings, in which.

DESCRIPTION OF THE ILLUSTRATED EMBODIMENT

Figures 1, 1A, 1B:
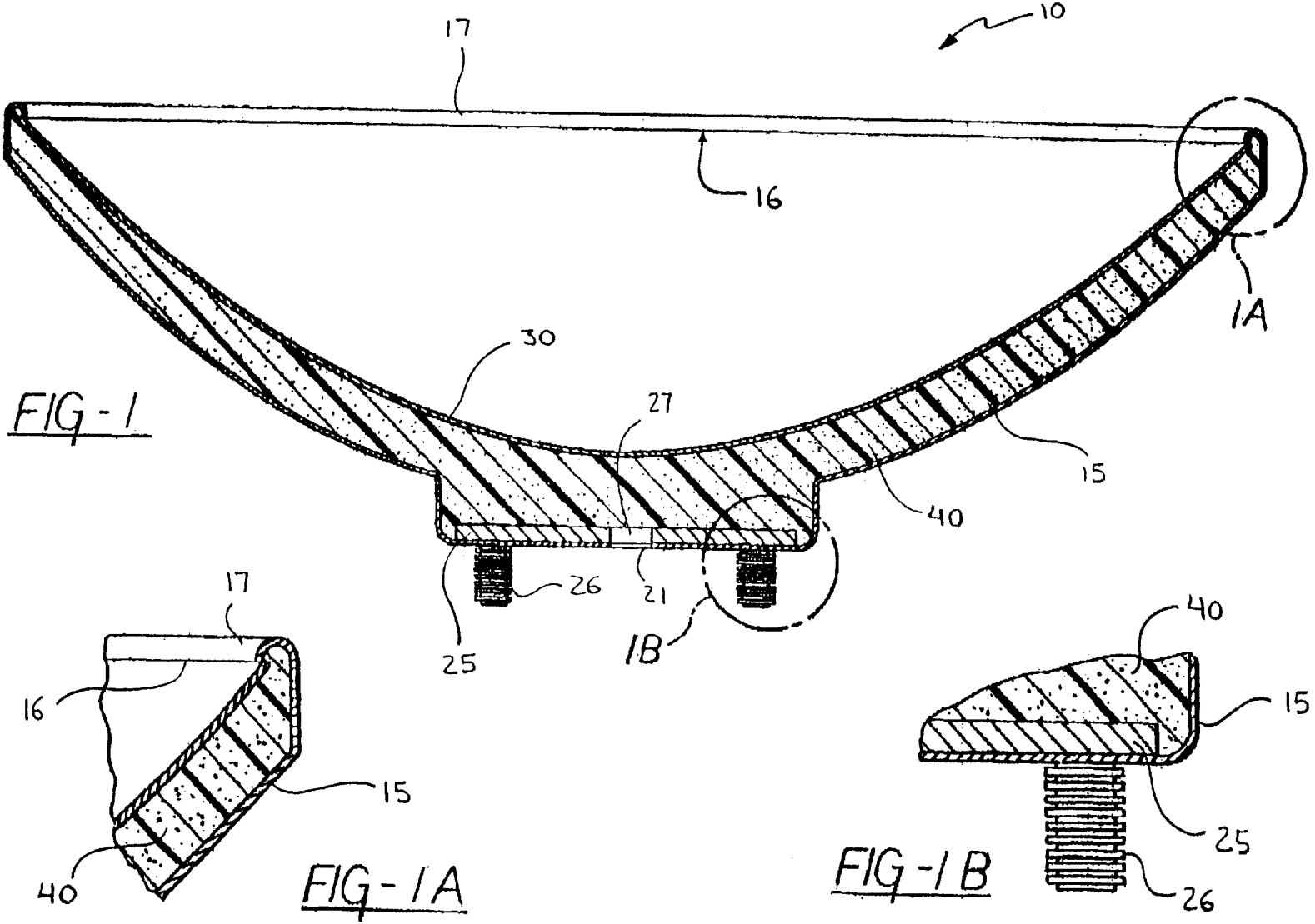
FIG. 1 comprises a cross-sectional view of one embodiment of the parabolic antenna of the present invention.
FIG. 1A comprises a detailed view of the parabolic antenna shown in FIG. 1.
FIG. 1B comprises a detailed view of the mounting system of the parabolic antenna of FIG. 1.

Referring now to the drawings, wherein like numerals indicate like or corresponding parts, the present inventive apparatus will be seen to generally comprise a parabolic antenna comprising at least a reflector of deformable material, the reflector having a parabolic shape of predetermined close tolerances, and a rigid structural substrate provided on one side of and coextensive with the reflector, the rigid structural substrate comprising a closed-cell foam sufficient to accurately maintain the close tolerances of the reflector's parabolic shape.

According to a first embodiment of this invention, shown in FIG. 1, the antenna 10 preferably includes a backing section 15 and a reflector 30, the backing section and reflector being mateable to define a hollow interior cavity filled with a closed-cell foam 40 forming a rigid support structure for maintaining the close tolerances of the reflector against distortion. The backing section 15 and reflector 30 comprise components formed of suitable material or materials, for instance metal, such as steel, an alloy, or other material or materials known to those of skill in the art to be suited to the purposes of antennas of the type referenced herein. According to the material or materials from which they are fashioned, the backing section 15 and reflector 30 may be formed by any conventional means. In the illustrated embodiments, the backing section 15 and reflector 30 are preferably stamped from metal, such as steel, according to conventional means, all as known to those of skill in the art. It will be appreciated from the remainder of this disclosure that the instant invention is particularly well suited to the economic manufacture of low-cost transmission antenna of precise tolerances that are fashioned from deformable materials such as steel and the like.

By virtue of the present invention, the backing section 15 and reflector 30 are able to be—and preferably are—formed from relatively thin material, being thereby characterized by deformability in their unassembled condition. It will be particularly appreciated with respect to the detailed description of the method of this invention that the reflector section 30 is ideally at least characterized by sufficiently deformability so as to be readily conforming to the preferred curvature for the reflector in the assembled antenna. In accordance with the illustrated embodiments, the reflector 30 and backing section 15 are each stamped from sheet metal having a thickness of from anywhere between approximately 0.010 to approximately 0.030 inches. Of course, these dimensions are exemplary only, and are not intended to be limiting of the present invention. Likewise, it will be appreciated by those of skill in the art that the shape and dimensions of the antennas of this disclosure are subject to variation according to the desired application. For instance, the antennas of this invention may be larger or smaller, may be characterized by various preferred curvatures, etc. It will also be understood that while the reflector 30 is preferably characterized by a curvature suitable to a given application, the backing section 15, if employed in an antenna according to this invention, need not necessarily have a complimentary curvature to the reflector 30, nor any curvature at all, the purpose of the backing section 15 in the illustrated embodiment being generally to facilitate mounting of the assembled antenna to a suitable support structure or surface, and to partially define a cavity for the closed-cell foam adjacent to the reflector.

Figure 2:
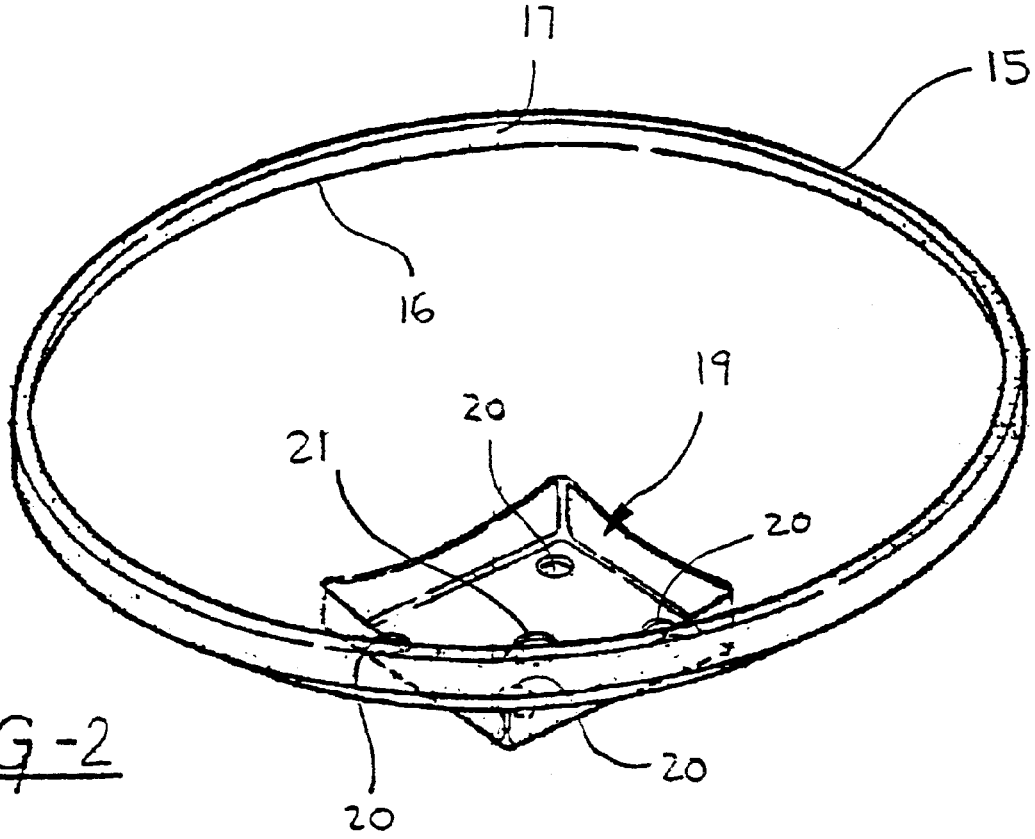
FIG. 2 is a perspective view of the backing section of the parabolic antenna of FIG. 1.
Figure 3:
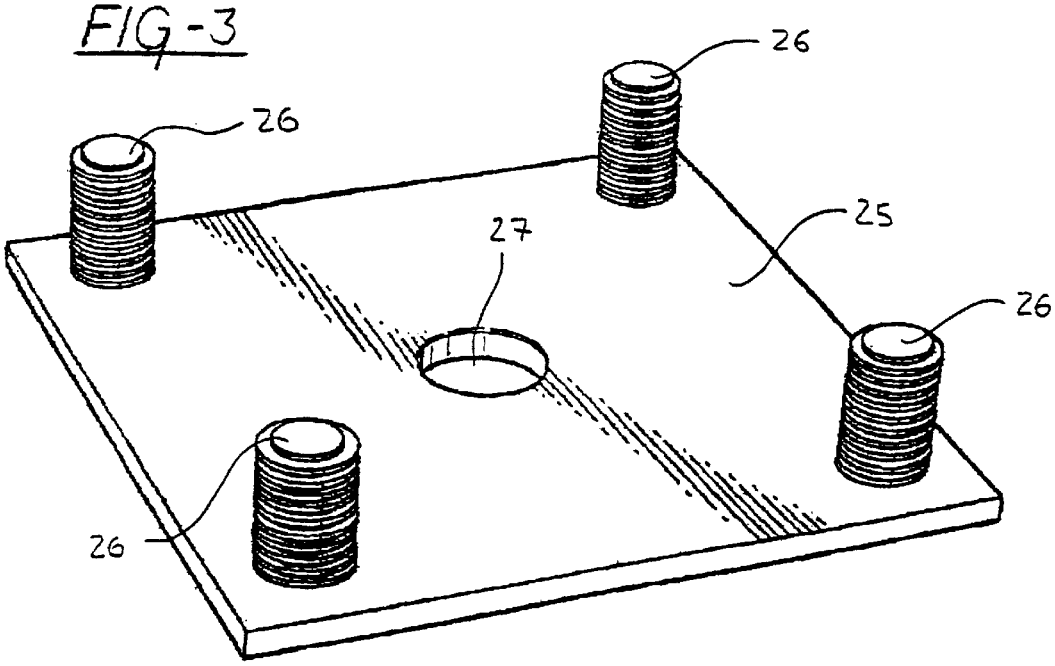
FIG. 3 is a perspective view of the mounting plate employed in the antenna of the embodiment of FIG. 1.

Referring now to FIGS. 1 through 3, the backing section 15 according to a first embodiment of the inventive antenna is shown to define a generally convex shape, and includes an annular bead 16 defined by an inwardly curving, radiused lip portion 17 of the backing section 15. The center, or apex, of the backing section 15 is preferably adapted for mounting the antenna to a support structure or surface, such as a mast (not shown), tripod, etc. The backing section 15 has formed therein a recess 19 dimensioned to receive a similarly dimensioned mounting plate 25. The mounting plate 25 is preferably manufactured from a suitably strong material. In the embodiment of this disclosure, the mounting plate 25 is formed from steel having a thickness of approximately 0.18 inches, although these characteristics are not intended to be limiting of the present invention. The recess 19 includes a plurality of bores 20 therethrough, each adapted to receive one of a plurality of threaded bolts 26 projecting from a surface of the mounting plate 25. As shown particularly in FIGS. 1 and 1B, these bolts 26 extend through the bores 20 and outwardly away from the backing section 15, thereby providing a means for the antenna 10 to be bolted to a support structure or surface (not shown), as mentioned above. Of course, the particular mounting means disclosed herein are only exemplary, the mounting plate or other mounting means for the antenna of this disclosure not forming part of the present invention.

A foam injection port 21, the employment of which is described in more detail below, is provided on at least one of the backing section 15 and/or the reflector 30. In the illustrated embodiment, the injection port 21 is provided on the backing section 15, positioned centrally in the recess 19. According to this first embodiment, the mounting plate 25 also includes a bore 27 therethrough, the bore 27 being arranged coaxially with the foam injection port 21 so as to permit the communication of the foam slurry into the cavity defined between the backing section 15 and reflector 30, all as described more fully below. Of course, it will be understood from this disclosure that the foam injection port 21 or ports may be provided elsewhere on the backing section 15 and/or reflector 30, consistent with maintaining acceptable antenna performance for a given application.

Still referring to FIGS. 1 and 2, the reflector 30 of the first embodiment will be seen to define a generally convex, "dish"-shape having an outside diameter less than the outside diameter of the backing section 15, but larger than the inside diameter of the backing section 15 as defined by the inside of the lip 17 proximate the bead 16. According to this design, the reflector 30 can be captured by, and is prohibited from axial separation relative to, the backing section 15 in the assembled antenna 10. As indicated, the precise curvature and size of the reflector 30 is determined by user desire and need, according to known methods, and may be altered without departing from the broader aspects of the present invention.

The closed-cell foam 40 comprising the rigid structure of the antenna 10 is of a commercially available type known in the art, being available, for instance, from the BASF corporation. This preferred foam is a thermal-set material which, when cured, forms a rigid structure the dimensions of which are not measurably influenced by temperatures of the kind likely to be encountered in environments where antennas such as of the type described are typically employed. The foam 40 is available as a liquid slurry that expands as it cures to form a rigid foam-like material. The injectable foam 40 expands in volume in proportion to the amount of slurry injected to occupy any cavity into which it is introduced. The cured foam is rigid but light-weight, and further characterized by a limited resiliency. Foams of the preferred type may be formed in varying densities, for instance 2 lbs., 4 lbs., 6 lbs., etc., these values referring to the weight of a cubic foot of foam upon curing. In practice, it has been discovered in connection with the present inventive antenna and method of manufacture that foam having a cured density of 2 lbs. per cubic foot in the cavity defined between the reflector and backing section is satisfactory to act as a rigid support structure sufficient to maintain the reflector in a predetermined parabolic shape of close tolerances in an antenna having an overall thickness in the range of approximately ¾ of an inch to approximately 1½ inches. Closed-cell foams are most preferred as they are not susceptible to environmental degradation such as can effect open-cell foams, for instance as may be caused by the migration of water into the foam. Of course, comparable materials may be substituted for the preferred material as described.

Given that the preferred foam expands while curing to occupy a known volume corresponding to the amount of slurry injected, it will be appreciated from this disclosure that the amount of foam slurry injected into the cavity is measured by suitable means to ensure that, upon curing, the foam provides a rigid structure to the antenna without altering the desired tolerances of the reflector. In the preferred method of this invention, described in more detail below, the amount of foam slurry injected into a cavity of a given size is regulated by injection time.

Figure 4:
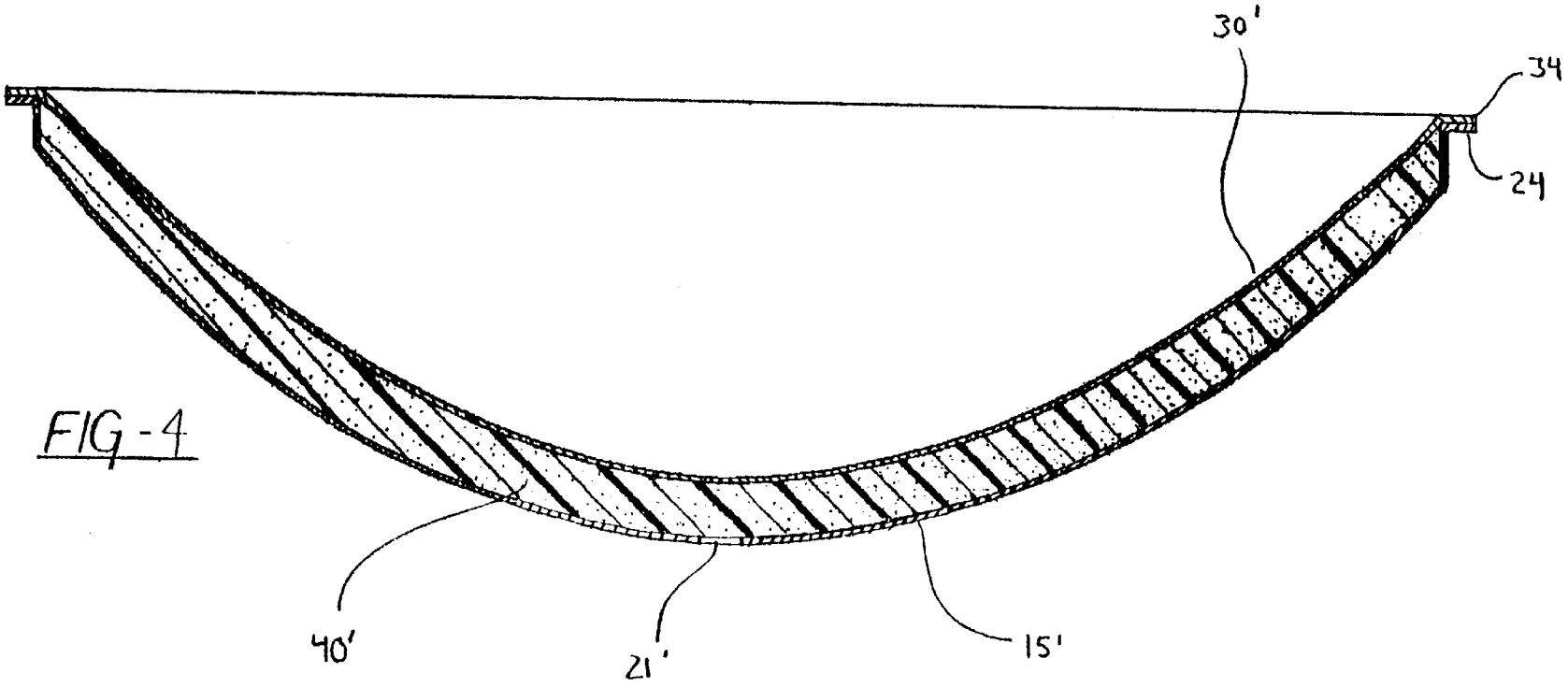
FIG. 4 comprises a cross-sectional view of a second embodiment of the parabolic antenna of the present invention.

Referring now to FIG. 4, a second embodiment of the antenna of this invention is shown to comprise mateable backing section 15' and reflector 30' characterized in that each of the backing section and reflector includes an outwardly radiating, annular rim 24, 34, respectively. The annular rims 24, 34 define axially confronting surfaces that abut when the backing section 15' and reflector 30' are mated. In this mated condition, shown in the FIG. 4, the backing section 15' and reflector 30' define a hollow interior cavity filled with closed-cell foam 40', such as described above. An injection port 21' is provided through the backing section 15' for injecting the foam slurry into the hollow interior cavity, as previously set forth. Further according to this embodiment, the foam 40' adheres to and forms a laminate of the backing section 15' and reflector 30', the backing section and reflector including no interrelating elements such as provided in the first embodiment of the inventive antenna.

It will be appreciated from the foregoing disclosure that the antenna of this invention may be manufactured by a variety of processes. However, it is also envisioned in this disclosure that the inventive antenna, or indeed any product where it is desired to maintain close tolerances, may be mass produced with the aid of a forming die designed to securely maintain the reflector curvature in a predetermined curvature of close tolerances until the closed-cell foam has cured to form a rigid support structure sufficient to accurately maintain the reflector in the close tolerances of the predetermined curvature.

More particular to the application of forming parabolic antennas, and especially transmitting antennas, the inventive method comprises the steps of:

(a) providing a backing section and a reflector made of deformable material, the backing section and reflector being mateable to define a hollow interior cavity, and at least the reflector having a first curvature;

(b) providing a forming die including a male portion comprising a vacuum buck having a curved surface of predetermined tolerances exactly corresponding to a second, preferred curvature of the reflector, and a female portion dimensioned to receive the backing section therein;

(c) positioning and maintaining the reflector on the vacuum buck under vacuum pressure in conformance with the curved surface corresponding to the second, preferred curvature of the reflector;

(d) mating the backing section to the reflector;

(e) capturing the backing section and reflector in the mated condition thereof between the male and female portions of the forming die;

(f) injecting an expandable, closed-cell foam slurry into the hollow interior cavity defined between the mated backing section and reflector;

(g) while maintaining the reflector on the vacuum buck in conformance with the curved surface corresponding to the second, preferred curvature of the reflector, curing the closed-cell foam slurry to form a rigid support structure; and (h) releasing the vacuum pressure at the vacuum buck to thereby form an antenna wherein the reflector has a curvature corresponding to the second, preferred curvature.

Referring now to FIGS. 5 through 8, the foregoing steps are explained in more detail with respect to the exemplary application of forming a parabolic antenna, by which example the inventive method, and its application to the manufacture of other products, will be thereby better understood.

Figure 5:
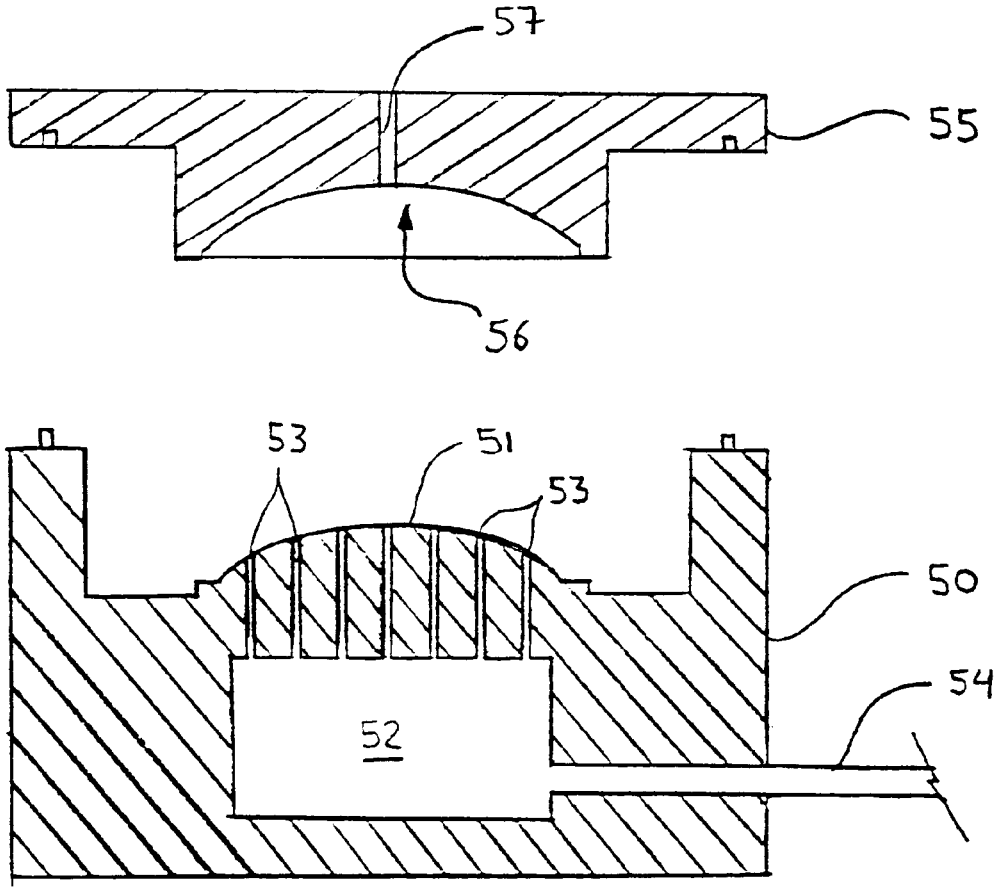
FIGS. 5 through 8 depict the steps of the methodology of this invention.

A forming die is provided including a male part comprising a vacuum buck 50 having a convex portion 51 the surface tolerances of which exactly correspond to the preferred close tolerances for the preferred curvature of the reflector 30 of the finished antenna, and a female part 55 having a concave portion 56 dimensioned to receive therein the backing section 15 of the antenna. (FIG. 5.) In the illustrated embodiment, the close tolerances of the convex portion 51 are achieved by the computer-aided miling of a suitable material, for instance a manufacturing-grade resin or aluminum, according to a computer-generated model of the optimum parabolic curvature for the finished antenna reflector. However, myriad other materials may be employed for the male and female parts of the forming die, including wood, steel, etc., the particular material of the forming die not comprising part of this invention.

According to the shape and dimensions of the backing section 15 as described in connection with the antenna of this invention, it will be seen with reference to the drawings that the female part 55 includes a bore 57 therethrough coaxially aligned with and communicating the injection port 16 with a regulatable source of the preferred closed-cell foam slurry (not shown).

Since shape "memory" and other material considerations make perfect fidelity to the preferred close tolerances of antennas practically impossible to achieve on a commercial scale in prior art forming methods for metal and polymer antennas especially, the reflector 30 is most preferably preformed from a deformable material to have a first curvature as closely corresponding to the surface tolerances of the convex portion 51 and so as closely corresponding to the preferred curvature of the reflector B as possible. Alternatively, it is also envisioned that the curvature of the reflector 30 may be formed on the male part 50 coincident with the remainder of the inventive method as described hereinafter. For purposes of this example, discussion will be made with reference to a reflector 30 preformed, for instance by stamping, with a first curvature approaching the close tolerances of the preferred curvature of the convex portion 51.

As discussed below, the male part 50 is adapted to securely maintain the reflector 15 thereon in exact or nearly exact conformance with the curvature of the convex portion 51. While this may be accomplished by a variety of means, it is most preferred that the male part 50 comprise a vacuum buck, whereby the reflector 30 is securely positioned on the convex portion 51 in exact or nearly exact conformance therewith by means of vacuum pressure. According to this most preferred method, the male part 50 includes a vacuum chamber 52 communicating with both a plurality of openings 53 provided through the convex portion 51, as well as, via a suitable connection 54, a regulatable vacuum source (not shown). Ideally, the openings 53 on the surface of the convex portion 51 are interconnected by superficial, recessed channels (not shown) that will communicate the vacuum pressure between the openings 53 so as to ensure the exertion of a sufficient vacuum force against the surface of reflector 30 to hold the reflector in exact or nearly exact conformance with the curvature of the convex portion 51.

Figure 6:
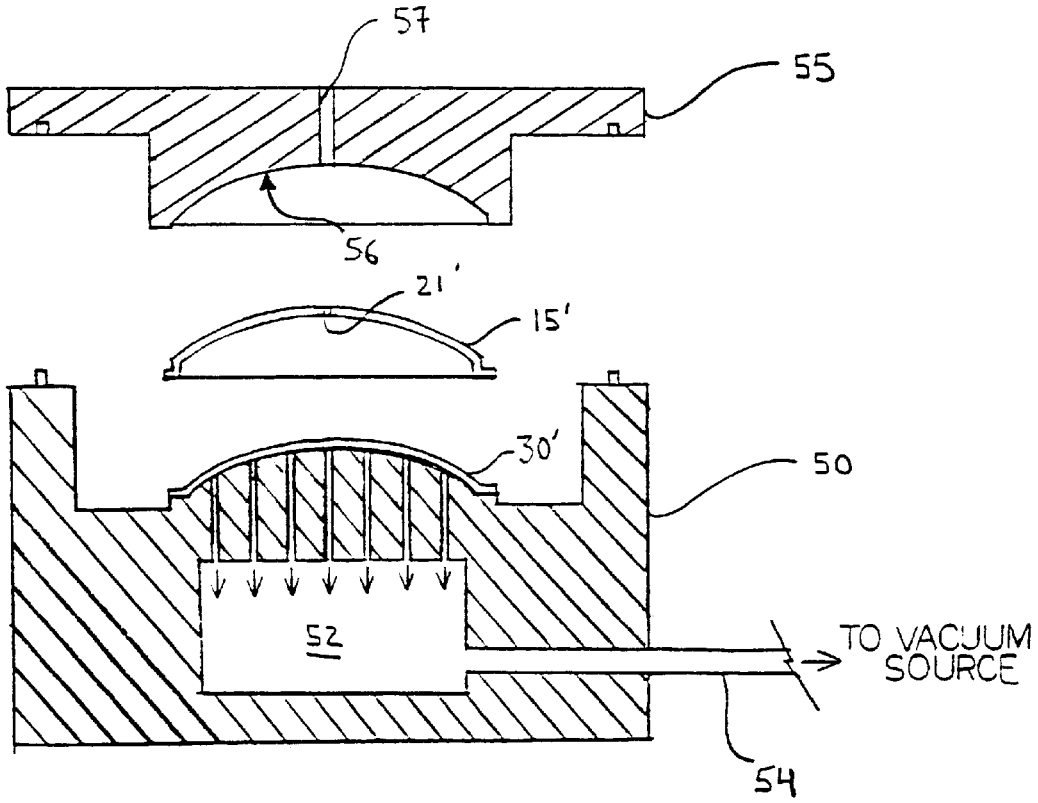
Figure 7:
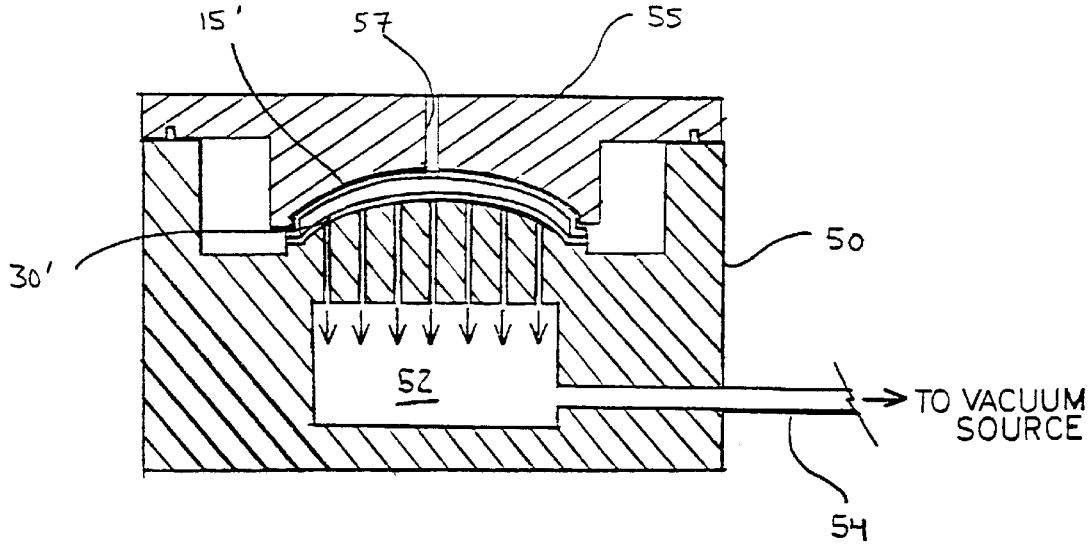
Figure 8:
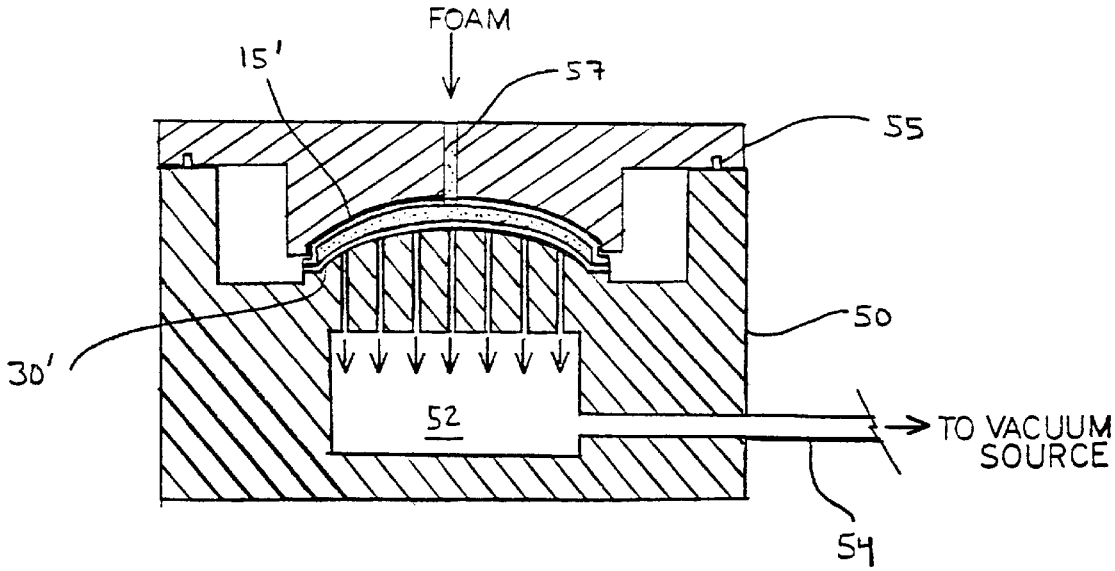

In operation of the inventive method, the reflector 30' of an antenna is provided, having been formed from a desired material and having desired dimensions and a first curvature approaching the close tolerances of the second, preferred curvature of the convex portion 51. The reflector 30' is then positioned on the convex portion 51 of the male part 50 and secured against movement in relation thereto, ideally by the application of vacuum pressure communicated to the surface of the convex portion 51 via the openings 53. (FIG. 6.) A backing section 15' formed from a desired material and having desired dimensions is provided, the backing section 15' being next aligned relative to the reflector 30. (FIG. 7.) Thereafter, the male 50 and female 55 parts are positioned relative to each other such that the backing section 15' is received in the concave portion 56, and the backing section 15' and reflector 30' are captured between the male 50 and female 55 parts in precise radial and axial alignment. It is important that the backing section 15 and reflector 30 be securely mated so as to ensure against the unwanted migration of foam slurry outside of the cavity. It is also important that the female part 55 define an opposing surface coextensive with and closely confronting the backing section 15, to thereby ensure that the closed-cell foam does not, during expansion thereof, deform the backing section. The closed-cell foam slurry is next injected through the bore 57 and injection port 21' and into the hollow cavity defined between the reflector 30' and backing section 15' of the antenna. (FIG. 8.) The amount of slurry injected into the cavity is measured to ensure that, upon curing, the foam provides a rigid structure to accurately maintain the curvature of the reflector 30' in the close tolerances of the second, preferred curvature. Upon complete curing of the closed-cell foam, the vacuum source (not shown) is extinguished and the male 50 and female 55 parts of the forming die are separated so that the completed antenna can be removed and the process repeated as desired in the formation of subsequent antennas.

By securely maintaining the deformable reflector on the vacuum die during curing of the foam slurry, it will be appreciated that the reflector of the resulting antenna is fixed in a curvature corresponding to the close tolerances of the preferred curvature.

It will also be appreciated from the above disclosure that the present invention improves upon the prior art by providing a parabolic antenna, and method of forming the same, that at once combines a robust design with a simple and economical means of manufacture.

Of course, the foregoing is merely illustrative of the present invention; those of ordinary skill in the art will appreciate that many additions and modifications to the present invention, as set out in this disclosure, are possible without departing from the spirit and broader aspects of this invention as defined in the appended claims.

The invention in which an exclusive property or privilege is claimed is defined as follows:

1. A parabolic antenna comprising at least a reflector of deformable material, the reflector having a parabolic shape of a preferred curvature, and a rigid structural substrate comprising a closed-cell foam sufficient to maintain said parabolic shape of the reflector against significant deviation from said parabolic shape and wherein further the deformable material of the at least one reflector is characterized by its inability to maintain the parabolic shape of a preferred curvature in the absence of the rigid structural substrate.

2. The parabolic antenna of claim 1, further comprising a backing section mateable with the reflector to define a hollow interior cavity, and the hollow interior cavity being filled with the closed-cell foam.

3. A method of forming a product with a preferred shape that is maintained against significant deviation from said preferred shape, the method comprising the steps of:

(a) providing material sections of a deformable material, the material sections being mateable to define a hollow interior cavity;

(b) maintaining the material sections on a forming die in a configuration corresponding to the preferred shape of the completed product; and (c) introducing a closed-cell foam slurry into the hollow interior cavity and allowing the closed-cell foam slurry to cure, thereby forming a rigid support structure adequate to maintain the mated material sections against significant deviation from the preferred shape following removal of the mated material sections from the forming die.

4. A method for forming a parabolic antenna, comprising the steps of:

(a) providing a backing section and a reflector made of deformable material, the backing section and reflector being mateable to define a hollow interior cavity, and at least the reflector having a first curvature;

(b) providing a forming die including at least a male form having a curved surface corresponding to a second, preferred curvature of the reflector;

(c) positioning and maintaining the reflector on the first, male form in conformance with the curved surface corresponding to the second, preferred curvature of the reflector;

(d) mating the backing section to the reflector;

(e) securing the backing section and the reflector in the mated condition thereof;

(e) injecting an expandable, closed-cell foam slurry into the hollow interior cavity defined between the mated backing section and reflector; and (f) forming the antenna with the reflector having a curvature corresponding to the second, preferred curvature by curing the closed-cell foam slurry.

5. A parabolic antenna comprising at least a reflector of deformable material, the reflector having a parabolic shape of a preferred curvature, and a rigid structural substrate comprising a foam sufficient to maintain said parabolic shape of the reflector against significant deviation from said parabolic shape, and wherein further the deformable material of the at least one reflector is characterized by its inability to maintain the parabolic shape of a preferred curvature in the absence of the rigid structural substrate.

6. The parabolic antenna of claim 5, further comprising a backing section mateable with the reflector to define a hollow interior cavity, and the hollow interior cavity being filled with the foam.

7. The parabolic antenna of claim 5, wherein the foam comprises a closed-cell foam.

8. The parabolic antenna of claim 7, further comprising a backing section mateable with the reflector to define a hollow interior cavity, and the hollow interior cavity being filled with the closed-cell foam.

9. A method of forming a product having a preferred shape that is maintained against significant deviation from said preferred shape, the method comprising the steps of:

(a) providing material sections of a deformable material, the material sections being mateable to define a hollow interior cavity;

(b) maintaining the material sections on a forming die in a configuration corresponding to the preferred shape of the completed product; and (c) introducing a foam slurry into the hollow interior cavity and allowing the foam slurry to cure, thereby forming a rigid support structure adequate to maintain the mated material sections in the preferred shape following removal of the mated material sections from the forming die.

10. The method of claim 9, wherein the foam slurry is a closed-cell foam slurry.

11. A method for forming a parabolic antenna, comprising the steps of:

(a) providing a backing section and a reflector made of deformable material, the backing section and reflector being mateable to define a hollow interior cavity, and at least the reflector having a first curvature;

(b) providing a forming die including at least a male form having a curved surface corresponding to a second, preferred curvature of the reflector;

(c) positioning and maintaining the reflector on the first, male form in conformance with the curved surface corresponding to the second, preferred curvature of the reflector;

(d) mating the backing section to the reflector;

(e) securing the backing section and the reflector in the mated condition thereof;

(e) injecting an expandable, foam slurry into the hollow interior cavity defined between the mated backing section and reflector; and (f) forming the antenna with the reflector having a curvature corresponding to the second, preferred curvature by curing the foam slurry.

12. The method of claim 11, wherein the foam slurry comprises a closed-cell foam slurry.

* * * * *

UNITED STATES PATENT AND TRADEMARK OFFICE

CERTIFICATE OF CORRECTION

PATENT NO. : 6,664,939 B1
DATED : December 16, 2003
INVENTOR(S) : Olinyk et al.

It is certified that error appears in the above-identified patent and that said Letters Patent is hereby corrected as shown below:

Column 6,
Line 63, please delete “miling” and insert -- milling --; and

Column 8,
Line 38, please delete “shape and” and insert -- shape, and --.

Signed and Sealed this

Tenth Day of February, 2004

JON W. DUDAS
*Acting Director of the United States Patent and Trademark Office*